US011411671B2

(12) United States Patent
Shah et al.

(10) Patent No.: US 11,411,671 B2
(45) Date of Patent: Aug. 9, 2022

(54) SYSTEMS AND METHODS FOR DISRUPTING UNAUTHORIZED COMMUNICATIONS IN LOW FREQUENCY RADIO COMMUNICATION DEVICES

(71) Applicant: Tata Consultancy Services Limited, Mumbai (IN)

(72) Inventors: Viral Prakash Shah, Thane (IN); Rishi Setiya, Thane (IN); Gurjeet Singh Sohal, Thane (IN); Fahim Khan, Thane (IN)

(73) Assignee: TATA CONSULTANCY SERVICES LIMITED, Mumbai (IN)

( * ) Notice: Subject to any disclaimer, the term of this patent is extended or adjusted under 35 U.S.C. 154(b) by 74 days.

(21) Appl. No.: 16/791,428

(22) Filed: Feb. 14, 2020

(65) Prior Publication Data

US 2020/0266916 A1 Aug. 20, 2020

(30) Foreign Application Priority Data

Feb. 15, 2019 (IN) ..... 201921006177

(51) Int. Cl.
*H04K 3/00* (2006.01)

(52) U.S. Cl.
CPC ..... *H04K 3/827* (2013.01)

(58) Field of Classification Search
CPC ..... H04K 3/827; H04K 3/00; H04K 3/28; H04K 3/40; H04K 3/41; H04K 3/415; H04K 3/42; H04K 3/43; H04K 3/44; H04K 3/45; H04K 3/46; H04K 3/60; H04K 3/62; H04K 3/65; H04K 3/68; H04K 3/80;

(Continued)

(56) References Cited

U.S. PATENT DOCUMENTS 3,806,926 A * 4/1974 Page ..... H04K 3/42 342/14
4,951,410 A * 8/1990 Ly ..... A01K 79/02 43/17.1

(Continued)

OTHER PUBLICATIONS

Nyamawe, A. et al. (Nov. 2014). "The Use of Mobile Phones in University Exams Cheating: Proposed Solution," *International Journal of Engineering Trends and Technology* (*IJETT*), vol. 17, No. 1; 5 pages.

*Primary Examiner* — Lana N Le
(74) *Attorney, Agent, or Firm* — Finnegan, Henderson, Farabow, Garrett & Dunner LLP

(57) ABSTRACT

Systems and methods for disrupting unauthorized communication in low frequency radio communication devices are provided. Traditional systems and methods may fail to provide for disrupting unauthorized communications by generating low frequency signals in the same band as the low frequency bands of the low frequency radio communication devices. Embodiments of the present disclosure provides for overcoming the limitations faced by the traditional systems and methods by generating, via a square wave generator and a device coil of a low frequency radio communication device, low frequency signals; integrating the low frequency signals on a computing device by implementing a power controlling technique; and disrupting, via the integrated low frequency signals on the computing device, unauthorized communications in the low frequency radio communication device.

11 Claims, 5 Drawing Sheets

(58) Field of Classification Search
CPC ..... H04K 3/82; H04K 3/822; H04K 3/825; H04K 2203/00; H04K 2203/10; H04K 2203/12; H04K 2203/14; H04K 2203/16; H04K 2203/18; H04K 2203/20; H04K 2203/22; H04K 2203/24; H04K 2203/30; H04K 2203/32; H04K 2203/34; H04K 2203/36; H04K 3/86; H04B 1/00; H04B 1/04; H04B 2001/0416; H04B 1/0458; H04B 1/40; H04B 10/40; H04B 10/564; H04B 1/48; H04B 1/0475; H04B 1/1607; H04B 2001/0408; H04B 1/50
USPC ..... 455/1
See application file for complete search history.

(56) References Cited

U.S. PATENT DOCUMENTS 5,001,771 A * 3/1991 New ..... H04K 3/45 455/73
5,170,411 A * 12/1992 Ishigaki ..... H04K 3/228 375/147
5,216,364 A * 6/1993 Ko ..... B60G 17/01933 324/207.17
6,970,070 B2 11/2005 Juels et al.
7,333,481 B1 2/2008 Rawat et al.
8,543,053 B1 * 9/2013 Melamed ..... H04K 3/46 455/226.1
9,734,365 B2 8/2017 Forster et al.
2006/0264168 A1 * 11/2006 Corbett ..... H04K 3/28 455/1
2010/0222015 A1 * 9/2010 Shimizu ..... H03F 1/3241 455/102
2012/0062330 A1 * 3/2012 Penn ..... H04B 1/40 29/846
2013/0023201 A1 * 1/2013 Coleman ..... H04K 3/42 455/1
2015/0207464 A1 * 7/2015 Yamanouchi ..... H03F 3/19 375/297
2016/0234356 A1 * 8/2016 Thomas ..... H04K 3/84
2017/0180419 A1 * 6/2017 Pedersen ..... H04W 12/04
2018/0342050 A1 * 11/2018 Fitzgerald ..... G06T 7/13
2019/0174452 A1 * 6/2019 Lev ..... H04B 17/27
2019/0297436 A1 * 9/2019 Solum ..... G06F 21/602
2020/0106545 A1 * 4/2020 Askar ..... H04K 3/28
2021/0250054 A1 * 8/2021 Tanaka ..... H03F 3/72

* cited by examiner

SYSTEMS AND METHODS FOR DISRUPTING UNAUTHORIZED COMMUNICATIONS IN LOW FREQUENCY RADIO COMMUNICATION DEVICES

PRIORITY CLAIM

This U.S. patent application claims priority under 35 U.S.C. § 119 to: India Application No. 201921006177, filed on Feb. 15, 2019. The entire contents of the aforementioned application are incorporated herein by reference.

TECHNICAL FIELD

This disclosure relates generally to low frequency radio systems, and more particularly to systems and methods for disrupting unauthorized communications in low frequency radio communication devices.

BACKGROUND

Digital word is growing rapidly and digital assessments are gaining lot of importance, especially in education and related domains. Increasingly, education systems are using digital tools to conduct online examinations and to assist with assessments. Educational institutions are using digital tools and technologies to administer, reports, manage tests and exams. When used in conjunction with right device(s) for learning, digital assessments can conduct examinations much quickly and safely, can provide immediate feedback to students and can provide educators with critical data that may further be used personalize instructions. However, privacy and security are the most critical aspects that are required to be taken care of while using digital technologies in education system. When not implemented properly, digital technologies may give an opportunity to resort to illegitimate means of writing examinations.

SUMMARY

Embodiments of the present disclosure present technological improvements as solutions to one or more of the above-mentioned technical problems recognized by the inventors in conventional systems. For example, in one embodiment, a a method for disrupting unauthorized communications in low frequency radio communication devices, the method comprising: identifying, by one or more hardware processors, a plurality of high frequency bands and a plurality of low frequency bands corresponding to a low frequency radio communication device, wherein the low frequency radio communication device comprises of a receiver; generating, via a square wave generator and a device coil, one or more low frequency signals corresponding to the plurality of low frequency bands, wherein the square wave generator and the device coil correspond to the low frequency radio communication device, and wherein the one or more low frequency signals are generated by implementing a frequency oscillation technique on the plurality of low frequency bands; integrating the one or more low frequency signals on a computing device by implementing a power controlling technique, wherein the computing device communicates with the low frequency radio communication device via the receiver; disrupting, via the integrated one or more low frequency signals on the computing device, unauthorized communications in the low frequency radio communication device; detecting, via a detection mechanism of the integrated one or more low frequency signals, a plurality of electromagnetic frequencies around the computing device, and wherein the detection mechanism is enabled via a microcontroller of the computing device; and non-disrupting of the integrated one or more low frequency signals corresponding to hearing-aid devices detected by the computing device.

In another aspect, there is provided a system for disrupting unauthorized communications in low frequency radio communication devices, the system comprising a memory storing instructions; one or more communication interfaces; and one or more hardware processors coupled to the memory via the one or more communication interfaces, wherein the one or more hardware processors are configured by the instructions to: identify a plurality of high frequency bands and a plurality of low frequency bands corresponding to a low frequency radio communication device, wherein the low frequency radio communication device comprises of a receiver; generate, via a square wave generator and a device coil, one or more low frequency signals corresponding to the plurality of low frequency bands, wherein the square wave generator and the device coil correspond to the low frequency radio communication device, and wherein the one or more low frequency signals are generated by implementing a frequency oscillation technique on the plurality of low frequency bands; integrate the one or more low frequency signals on a computing device by implementing a power controlling technique, wherein the computing device communicates with the low frequency radio communication device via the receiver; disrupt, via the integrated one or more low frequency signals on the computing device, unauthorized communications in the low frequency radio communication device; detecting, via a detection mechanism of the integrated one or more low frequency signals, a plurality of electromagnetic frequencies around the computing device, and wherein the detection mechanism is enabled via a microcontroller of the computing device; and non-disrupting of the integrated one or more low frequency signals corresponding to hearing-aid devices detected by the computing device.

In yet another aspect, there is provided one or more non-transitory machine readable information storage mediums comprising one or more instructions which when executed by one or more hardware processors causes the one or more hardware processors to perform a method for disrupting unauthorized communications in low frequency radio communication devices, the method comprising: identifying a plurality of high frequency bands and a plurality of low frequency bands corresponding to a low frequency radio communication device, wherein the low frequency radio communication device comprises of a receiver; generating, via a square wave generator and a device coil, one or more low frequency signals corresponding to the plurality of low frequency bands, wherein the square wave generator and the device coil correspond to the low frequency radio communication device, and wherein the one or more low frequency signals are generated by implementing a frequency oscillation technique on the plurality of low frequency bands; integrating the one or more low frequency signals on a computing device by implementing a power controlling technique, wherein the computing device communicates with the low frequency radio communication device via the receiver; disrupting, via the integrated one or more low frequency signals on the computing device, unauthorized communications in the low frequency radio communication device; detecting, via a detection mechanism of the integrated one or more low frequency signals, a plurality of electromagnetic frequencies around the computing device, and wherein the detection mechanism is enabled via a microcontroller of the computing device; and non-disrupting of the integrated one or more low frequency signals corresponding to hearing-aid devices detected by the computing device.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

Figure 1:
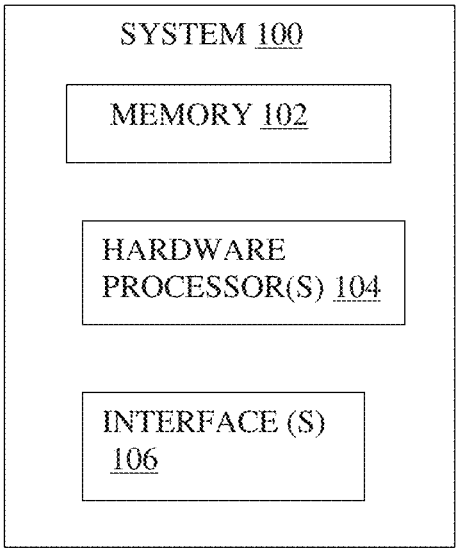
FIG. 1 illustrates block diagram of a system for disrupting unauthorized communications in low frequency radio communication devices, in accordance with some embodiments of the present disclosure.

Exemplary embodiments are described with reference to the accompanying drawings. In the figures, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the scope of the disclosed embodiments. It is intended that the following detailed description be considered as exemplary only, with the true scope being indicated by the following claims.

Embodiments of the present disclosure provide systems and methods for disrupting unauthorized communications in low frequency radio communication devices. Digital learning can be defined as a web based learning which effectively makes use of the information technology to impart knowledge to the students. Digital processing systems encourage active learning, knowledge construction, inquiry, and exploration on the part of the learners, and allow for remote communication as well as data sharing to take place between teachers and/or learners in different physical classroom locations. Digital technology can often be exciting for learners and offers a potentially more engaging alternative, it can enhance and transform the learning process for students.

Infusing digital technology in classrooms aims to prepare students for the future workforce, that is, for jobs that will likely involve technologies and require the types of skills that are being taught alongside how the technology is used. The introduction of education system has led to the reduction and elimination of the burdensome paper work which was part of the earlier system. Since most of the exams conducted are online, the teachers do not need to carry bundles of answer sheet to their home for evaluation.

However, while implementing digital technology, it is essential to take into consideration various security aspects. Secure Online examination System would provide better and safe online exams. It can also help to increase brand and reputation of the institution. Majority of the entrance exams in education institute, recruitment exams for hiring, certification exams from professional certification authorities, psychometric tests to assess personality are conducted online. Secure exam process is essential if one wishes to get advantage from digital technology usages. It can prevent misuse of technology and prevention of cheating can be achieved.

The method disclosed attempts to overcome the limitations faced by traditional systems and methods, especially while implementing/using digital technologies in education system. For example, the method discloses provides for disrupting unauthorized communications in low frequency radio systems, so that such systems cannot be misused illegitimately for cheating in examinations.

Referring now to the drawings, and more particularly to FIG. 1 through 6, where similar reference characters denote corresponding features consistently throughout the figures, there are shown preferred embodiments and these embodiments are described in the context of the following exemplary system and/or method.

FIG. 1 illustrates an exemplary block diagram of a system 100 for disrupting unauthorized communications in low frequency radio communication devices, in accordance with an embodiment of the present disclosure. In an embodiment, the system 100 includes one or more processors 104, communication interface device(s) or input/output (I/O) interface(s) 106, and one or more data storage devices or memory 102 operatively coupled to the one or more processors 104. The one or more processors 104 that are hardware processors can be implemented as one or more microprocessors, microcomputers, microcontrollers, digital signal processors, central processing units, state machines, logic circuitries, and/or any devices that manipulate signals based on operational instructions. Among other capabilities, the processor(s) is configured to fetch and execute computer-readable instructions stored in the memory 102. In an embodiment, the system 100 can be implemented in a variety of computing systems, such as laptop computers, notebooks, hand-held devices, workstations, mainframe computers, servers, a network cloud and the like.

The I/O interface device(s) 106 can include a variety of software and hardware interfaces, for example, a web interface, a graphical user interface, and the like and can facilitate multiple communications within a wide variety of networks N/W and protocol types, including wired networks, for example, LAN, cable, etc., and wireless networks, such as WLAN, cellular, or satellite. In an embodiment, the I/O interface device(s) can include one or more ports for connecting a number of devices to one another or to another server. The system 100, through the I/O interface 106 may be coupled to external data sources.

The memory 102 may include any computer-readable medium known in the art including, for example, volatile memory, such as static random access memory (SRAM) and dynamic random access memory (DRAM), and/or non-volatile memory, such as read only memory (ROM), erasable programmable ROM, flash memories, hard disks, optical disks, and magnetic tapes. In an embodiment, the memory 102 can be configured to store any data that is associated with the disrupting of unauthorized communications in low frequency radio communication devices. In an embodiment, the information pertaining to high and low frequency bands, generated low frequency signals, and disrupting of unauthorized communications in low frequency radio communication devices etc. is stored in the memory 102. Further, all information (inputs, outputs and so on) pertaining to the disrupting of unauthorized communications in low frequency radio communication devices, may also be stored in the database, as history data, for reference purpose.

Figure 2:
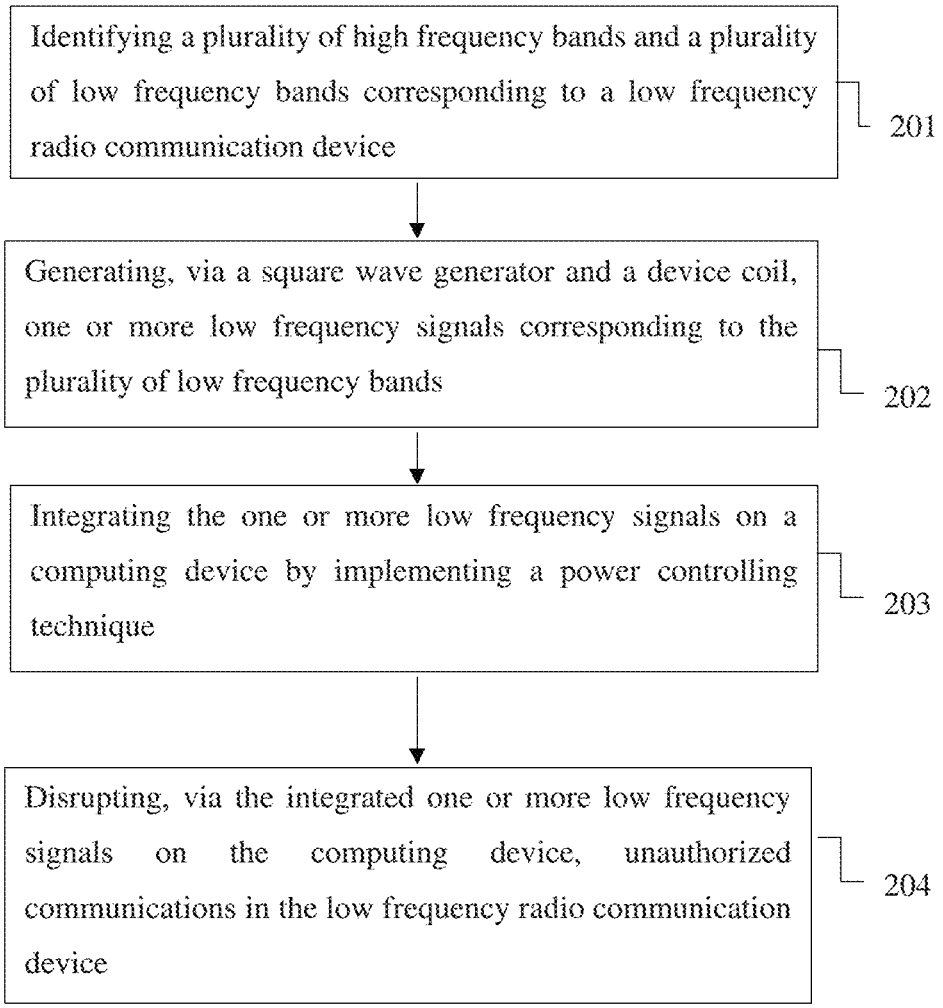
FIG. 2 is a flow diagram illustrating the steps involved in the process of disrupting unauthorized communications in low frequency radio communication devices, in accordance with some embodiments of the present disclosure.
Figure 3:
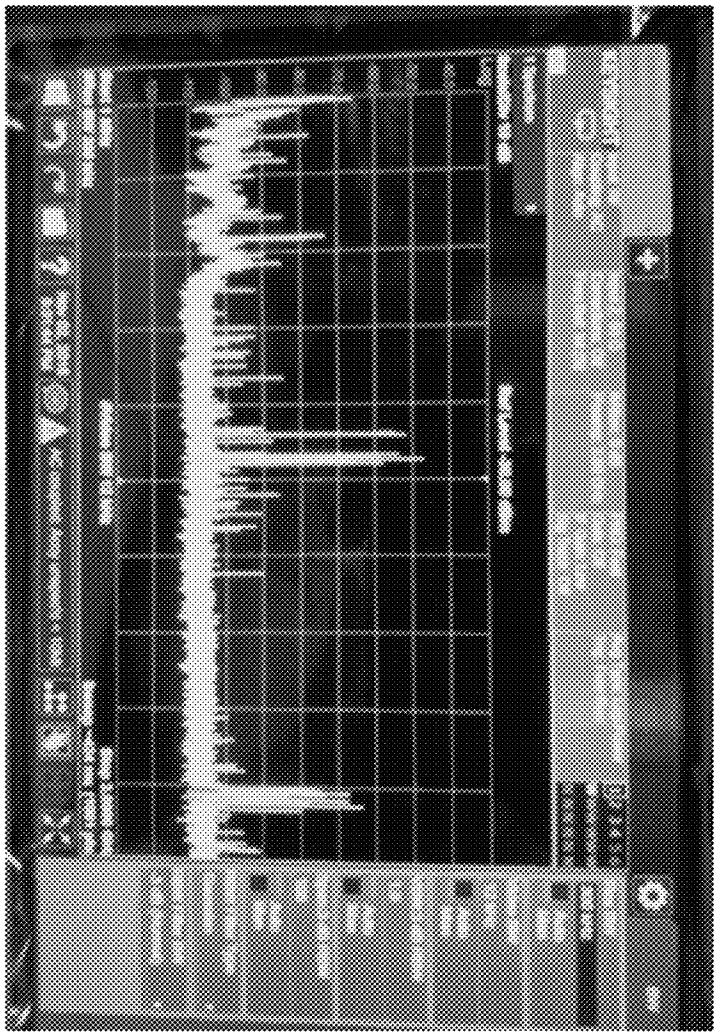
FIG. 3 illustrates an example of a spectrum graphical output of a plurality of high frequency bands and a plurality of low frequency bands generated using a standard spectrum analyzer, in accordance with some embodiments of the present disclosure.

FIG. 2, with reference to FIG. 1, illustrates an exemplary flow diagram of a method for disrupting unauthorized communication in low frequency radio communication devices, in accordance with some embodiments of the present disclosure. In an embodiment the system 100 comprises one or more data storage devices of the memory 102 operatively coupled to the one or more hardware processors 104 and is configured to store instructions for execution of steps of the method by the one or more processors 104. The steps of the method of the present disclosure will now be explained with reference to the components of the system 100 as depicted in FIG. 1 and the flow diagram. In the embodiments of the present disclosure, the hardware processors 104 when configured the instructions performs one or more methodologies described herein.

According to an embodiment of the present disclosure, at step 201, the one or more hardware processors 104 are configured to identify a plurality of high frequency bands and a plurality of low frequency bands corresponding to a low frequency radio communication device. As is known in the art, the radio spectrum, that is, the radio-communication portion of the electromagnetic spectrum extends from a very-low-frequency band to an extremely-high-frequency band. Although a low frequency radio communication device has specialized uses, but such a device may also be used unauthorized communications, especially during examinations.

In general, a low frequency radio communication device that is used for unauthorized communication(s) (especially during examinations) comprises of a Global System for Mobile Communications (GSM) module used for connecting the low frequency radio communication device to the external world, and an audio output of the GSM module is connected to a coil. The low frequency radiation from the coil is coupled to a receiver (or a hidden ear piece) of a user to listen the external world. The magnetic field lines couple the audio output to the receiver.

The frequency bands used in such low frequency radio communication devices are both low frequency bands and high frequency bands. As is known in the art, high frequency bands are 2G, 3G and 4G bands, while low frequency range is 20 Hz to 20 kHz (20 Hz-20,000 Hz). The method disclosed provides for mitigation of the low frequency bands for disrupting unauthorized communication(s). Hence, initially the plurality of high frequency bands and the plurality of low frequency bands are identified for the low frequency radio communication device. In an example implementation, by referring to FIG. 3, an example of the identified plurality of high frequency bands and the plurality of low frequency bands may be referred, wherein the identified plurality of high frequency bands and the plurality of low frequency bands are generated using a standard spectrum analyzer.

According to an embodiment of the present disclosure, at step 202, the one or more hardware processors 104 are configured to generate, via a square wave generator and a device coil of the low frequency radio communication device, one or more low frequency signals corresponding to the plurality of low frequency bands. Thus, upon identification of the plurality of low frequency bands, the one or more low frequency signals may be generated in the same band, so that the one or more low frequency signals so generated may continuously interfere with the communication between a transmitter module and the receiver. By using the method disclosed, the signal generating system continuously disturbs the user via the one or more low frequency signals, thereby disrupting unauthorized communications in any low frequency radio communication device.

In an embodiment, the one or more low frequency signals are generated by implementing a frequency oscillation technique on the plurality of low frequency bands. The one or more low frequency signals that are generated for disrupting unauthorized communications are amplified 1 Hz frequency signals for creating interruption in external communication device which is working in audio frequency. Thus, the one or more low frequency signals generated by implementing the frequency oscillation technique are square wave signals which start oscillation Timer IC.

Figure 4:
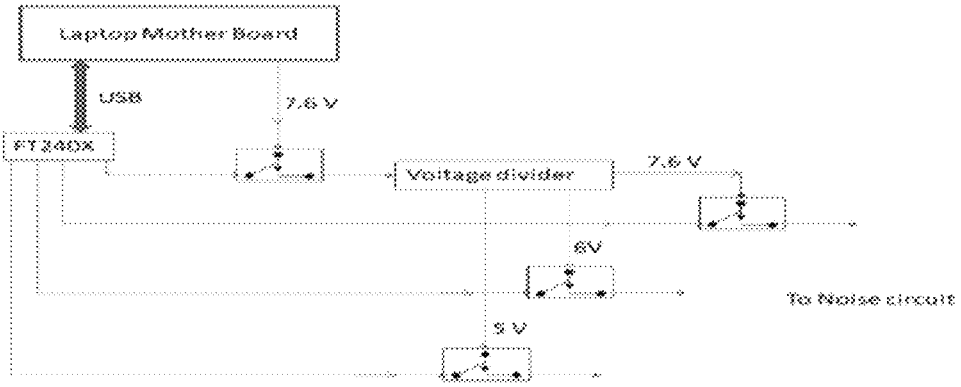
FIG. 4 illustrates a design for programmatically controlling one or more low frequency signals via a voltage divider (or a voltage controller), in accordance with some embodiments of the present disclosure.
Figure 5:
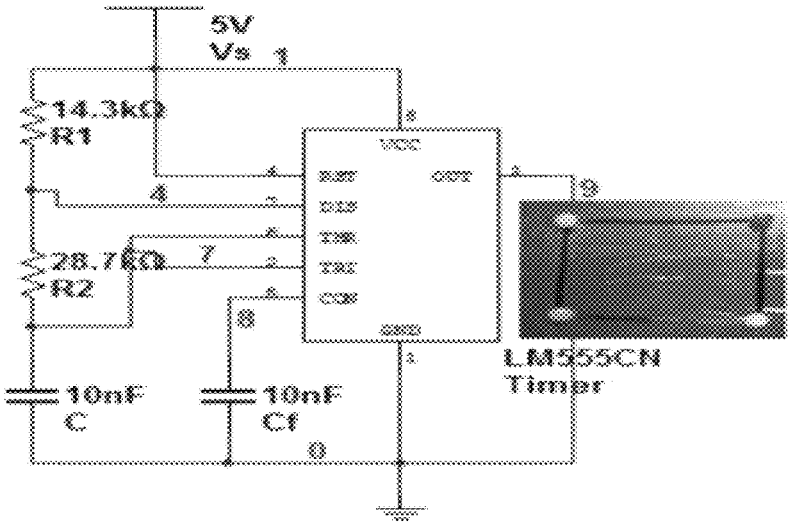
FIG. 5 is illustrates an example of a design of generated one or more low frequency signals, that are square wave signals generated using a 555 Timer IC, in accordance with some embodiments of the present disclosure.
Figure 6:
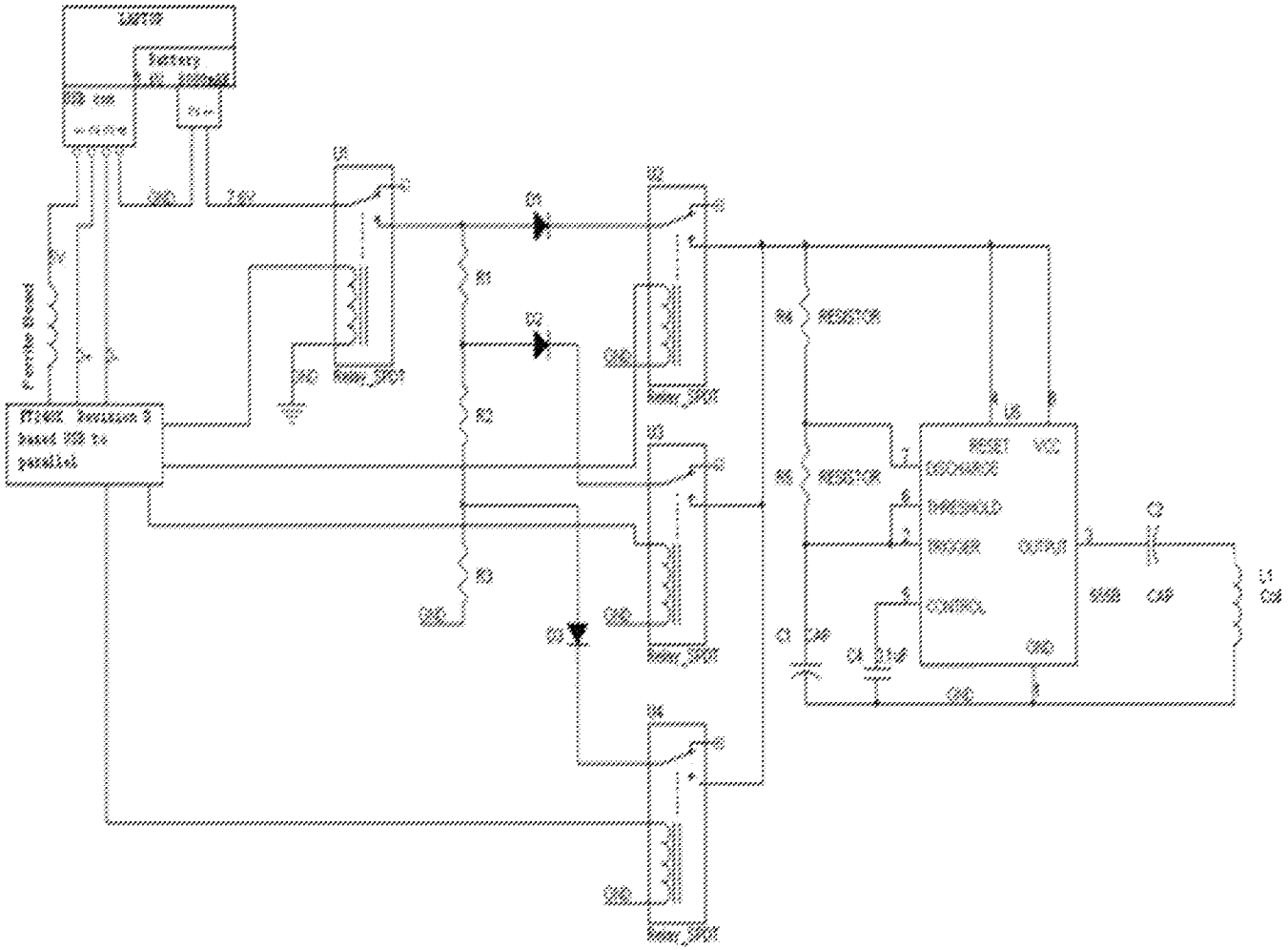
FIG. 6 illustrates a complete integration of the one or more low frequency signals on a computing device, in accordance with some embodiments of the present disclosure.

By referring to FIG. 4, it may be noted that the proposed design for integrating comprises of a voltage divider (also herein referred to as a voltage controller) for programmatically controlling the integrated one or more low frequency signals on the computing device. Further, by referring to FIG. 5, an example of the design of generated one or more low frequency signals, that are square wave signals generated using a 555 Timer IC, may be referred.

According to an embodiment of the present disclosure, at step 203, the one or more hardware processors 104 are configured to integrate the one or more low frequency signals on a computing device by implementing a power controlling technique. The computing device may comprise of any electronic device, an information processing system that takes inputs and generates some output, for example, a laptop or any desktop. The computing device (on the one or more low frequency signals are integrated) which communicates with the low frequency radio communication device via the receiver. The power controlling technique implements a programmable IC which act as a relay controller to switch between varied powers to amplify the signal.

In an embodiment, for integrating, the range of the one or more low frequency signals is kept at 2-3 feet so that the one or more low frequency signals do disturb other surrounding systems upon integration. Further, the power from the one or more low frequency signals is low enough to avoid any electromagnetic interference(s) to the computing device, but high enough to disturb the receiver. Further, the integration of the one or more low frequency signals is observed to result in low power consumption of the computing device. By referring to FIG. 6, a complete integration of the one or more low frequency signals on the computing device may be referred.

By referring to FIG. 6 again, it may be noted that a FT240X or any alternate chip facilitates programmatic controlling (ON/OFF) of the integrated one or more low frequency signals. Further, the proposed design comprises of a plurality of coils, wherein each of the plurality of coils has dimensions of 10.5×11.0 cm, the number of turns 29, and the gauge of the wire is 24/26. The proposed design may comprise of an alternate coil with a dimension of 6.0×3.5 cm and 36 gauge wire.

The programmatically controlling of the integrated one or more low frequency signals on the computing device facilitates non-disrupting of the integrated one or more low frequency signals corresponding to hearing-aid devices detected by the computing device, that is, handicapped candidates using hearing-aid devices (or marked as hearing impaired) can use hearing-aid devices and the programmatic controlling ensures that an integrated circuit is not started so as to generate any low frequency signals, and hence it will not disrupt the hearing-aid device(s).

By referring to FIG. 5 yet again, it may be noted that the battery source of the computing device (that is a laptop) is 7.6 volts and 8000 mAH. The approximate power required for the integrated one or more low frequency signals is less than 0.15 W. Assuming duration of examination is around three hours, the proposed design with the integrated one or more low frequency signals with a consumption of 150 mW even do cause any issues, even if it runs continuously. This proposed design with the integrated one or more low frequency signals was also tested for interference with regular operation of laptops. It was observed the integrated one or more low frequency signals do not disturb the performance of the laptop and in particular the audio section of a sound card.

The one or more low frequency signals are generated as robust electromagnetic waves upon integration in the computing device for disrupting unauthorized communications in the low frequency radio communication device, that is, the integrated one or more low frequency signals are much robust as compared to any signals generated by the low frequency radio communication device (communicating with the computing device) using the GSM module and the coil. The computing device comprises a microcontroller (not shown in the figure) that enables a detection mechanism of the integrated one or more low frequency signals for detecting a plurality of electromagnetic around the computing device waves via a Wifi or an antenna.

According to an embodiment of the present disclosure, at step 204, the one or more low frequency signals upon integration on the computing device disrupt unauthorized communications in the low frequency radio communication device. As mentioned above, since the integrated one or more low frequency signals are much robust as compared to any other signals in near vicinity, the receiver of the low frequency radio communication device receives such robust integrated one or more low frequency signals, thereby mitigating/disturbing the communication of the receiver with the GSM module. Further, the integrated one or more low frequency signals drains the battery of the low frequency radio communication device from a predefined range, thereby disrupting any unauthorized communications.

According to an embodiment of the present disclosure, advantages of implementing the method disclosed may be considered in detail. The method disclosed may also be implemented in other areas wherein unauthorized communications are to be disrupted, for example, in military purposes and other sensitive areas. The one or more low frequency signals when integrated on the computing device provides for less consumption of battery of the computing device. Also, the integrated one or more low frequency signals do not disturb the performance of the computing device.

Further, by implementing the proposed methodology, it was observed that the performance of the square wave was better than the sine wave and the frequency of operation is optimum at 1.4 to 2.4 KHz. A 555 IC based circuit will generate the tone of required frequency and its output is connected to the coil which will radiate. The output power of the system can be varied by activation of the appropriate relay.

The written description describes the subject matter herein to enable any person skilled in the art to make and use the embodiments. The scope of the subject matter embodiments is defined by the claims and may include other modifications that occur to those skilled in the art. Such other modifications are intended to be within the scope of the claims if they have similar elements that do not differ from the literal language of the claims or if they include equivalent elements with insubstantial differences from the literal language of the claims.

The embodiments of present disclosure herein addresses unresolved problem of disrupting unauthorized communications in low frequency radio communication devices. The embodiment, thus provides for generating the one or more low frequency signals as robust electromagnetic waves upon integration in the computing device for disrupting unauthorized communications in the low frequency radio communication device. Moreover, the embodiments herein further provides for draining a battery of the low frequency radio communication device from a predefined range, and detecting, via a detection mechanism of the integrated one or more low frequency signals, a plurality of electromagnetic frequencies around the computing device.

It is to be understood that the scope of the protection is extended to such a program and in addition to a computer-readable means having a message therein; such computer-readable storage means contain program-code means for implementation of one or more steps of the method, when the program runs on a server or mobile device or any suitable programmable device. The hardware device can be any kind of device which can be programmed including e.g. any kind of computer like a server or a personal computer, or the like, or any combination thereof. The device may also include means which could be e.g. hardware means like e.g. an application-specific integrated circuit (ASIC), a field-programmable gate array (FPGA), or a combination of hardware and software means, e.g. an ASIC and an FPGA, or at least one microprocessor and at least one memory with software modules located therein. Thus, the means can include both hardware means and software means. The method embodiments described herein could be implemented in hardware and software. The device may also include software means. Alternatively, the embodiments may be implemented on different hardware devices, e.g. using a plurality of CPUs.

The embodiments herein can comprise hardware and software elements. The embodiments that are implemented in software include but are not limited to, firmware, resident software, microcode, etc. The functions performed by various modules described herein may be implemented in other modules or combinations of other modules. For the purposes of this description, a computer-usable or computer readable medium can be any apparatus that can comprise, store, communicate, propagate, or transport the program for use by or in connection with the instruction execution system, apparatus, or device.

The illustrated steps are set out to explain the exemplary embodiments shown, and it should be anticipated that ongoing technological development will change the manner in which particular functions are performed. These examples are presented herein for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

Furthermore, one or more computer-readable storage media may be utilized in implementing embodiments consistent with the present disclosure. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., be non-transitory. Examples include random access memory (RAM), read-only memory (ROM), volatile memory, nonvolatile memory, hard drives, CD ROMs, DVDs, flash drives, disks, and any other known physical storage media.

It is intended that the disclosure and examples be considered as exemplary only, with a true scope of disclosed embodiments being indicated by the following claims.

What is claimed is:

1. A method for disrupting unauthorized communications in low frequency radio communication devices, the method comprising:

identifying, by one or more hardware processors, a plurality of high frequency bands and a plurality of low frequency bands corresponding to a low frequency radio communication device, wherein the low frequency radio communication device comprises of a receiver;

generating, via a square wave generator and a device coil, one or more low frequency signals corresponding to the plurality of low frequency bands, wherein the square wave generator and the device coil correspond to the low frequency radio communication device, and wherein the one or more low frequency signals are generated by implementing a frequency oscillation technique on the plurality of low frequency bands, wherein the one or more low frequency signals generated, continuously interfere with communication between a transmitter module and the receiver and wherein the plurality of low frequency bands are generated by a standard spectrum analyzer;

integrating the one or more low frequency signals on a computing device by implementing a power controlling technique over the one or more integrated low frequency signals, wherein the computing device communicates with the low frequency radio communication device via the receiver and implementing a programmable IC to act as a relay controller for switching between one or more varied powers to amplify the integrated one or more low frequency signals, wherein power from the one or more integrated low frequency signals is enabled to be low enough to avoid electromagnetic interference to the computing device and the power from the one or more integrated low frequency signals is high enough to disturb the receiver;

facilitating non-disruption of the one or more integrated low frequency signals corresponding to at least one hearing aid device detected by the computing device by programmatically controlling the one or more integrated low frequency signals on the computing device, wherein the integrated one or more low frequency signals are programmatically controlled via a voltage controller for disrupting unauthorized communications in the low frequency radio communication device; and disrupting, via the integrated one or more low frequency signals on the computing device, unauthorized communications in the low frequency radio communication device and wherein the one or more generated low frequency signals for disrupting the unauthorized communications are amplified 1Hz frequency signals for creating an interruption in an external communication device working in audio frequency.

2. The method as claimed in claim 1, wherein the one or more low frequency signals are generated as robust electromagnetic waves upon integration in the computing device for disrupting unauthorized communications in the low frequency radio communication device.

3. The method as claimed in claim 1, wherein the step of disrupting unauthorized communications comprises draining a battery of the low frequency radio communication device from a predefined range for disrupting unauthorized communications in the low frequency radio communication device.

4. The method as claimed in claim 3, wherein the step of draining the battery is performed via the integrated one or more low frequency signals on the computing device.

5. The method as claimed in claim 1, wherein the step of disrupting is preceded by detecting, via a detection mechanism of the integrated one or more low frequency signals, a plurality of electromagnetic frequencies around the computing device, and wherein the detection mechanism is enabled via a microcontroller of the computing device.

6. A system (100) for disrupting unauthorized communications in low frequency radio communication devices, the system (100) comprising:

a memory (102) storing instructions;

one or more communication interfaces (106); and one or more hardware processors (104) coupled to the memory (102) via the one or more communication interfaces (106), wherein the one or more hardware processors (104) are configured by the instructions to:

identify a plurality of high frequency bands and a plurality of low frequency bands corresponding to a low frequency radio communication device, wherein the low frequency radio communication device comprises of a receiver;

generate, via a square wave generator and a device coil, one or more low frequency signals corresponding to the plurality of low frequency bands, wherein the square wave generator and the device coil correspond to the low frequency radio communication device, and wherein the one or more low frequency signals are generated by implementing a frequency oscillation technique on the plurality of low frequency bands, wherein the one or more low frequency signals generated, continuously interfere with communication between a transmitter module and the receiver and wherein the plurality of low frequency bands are generated by a standard spectrum analyzer;

integrate the one or more low frequency signals on a computing device by implementing a power controlling technique over the one or more integrated low frequency signals, wherein the computing device communicates with the low frequency radio communication device via the receiver and implement a programmable IC to act as a relay controller for switching between one or more varied powers to amplify the integrated one or more low frequency signals, wherein power from the one or more integrated low frequency signals is enabled to be low enough to avoid electromagnetic interference to the computing device and the power from the one or more integrated low frequency signals is high enough to disturb the receiver;

facilitate non-disruption of the one or more integrated low frequency signals corresponding to at least one hearing aid device detected by the computing device by programmatically controlling the one or more integrated low frequency signals on the computing device, wherein the integrated one or more low frequency signals are programmatically controlled via a voltage controller for disrupting unauthorized communications in the low frequency radio communication device; and disrupt, via the integrated one or more low frequency signals on the computing device, unauthorized communications in the low frequency radio communication device and wherein the one or more generated low frequency signals for disrupting the unauthorized communications are amplified 1Hz frequency signals for creating an interruption in an external communication device working in audio frequency.

7. The system (100) as claimed in claim 6, the one or more low frequency signals are generated as robust electromagnetic waves upon integration in the computing device for disrupting unauthorized communications in the low frequency radio communication device.

8. The system (100) as claimed in claim 6, wherein the step of disrupting unauthorized communications comprises draining a battery of the low frequency radio communication device from a predefined range for disrupting unauthorized communications in the low frequency radio communication device.

9. The system (100) as claimed in claim 8, wherein the step of draining the battery is performed via the integrated one or more low frequency signals on the computing device.

10. The system as claimed in claim 6, wherein the step of disrupting is preceded by detecting, via a detection mechanism of the integrated one or more low frequency signals, a plurality of electromagnetic frequencies around the computing device, and wherein the detection mechanism is enabled via a microcontroller of the computing device.

11. One or more non-transitory machine readable information storage mediums comprising one or more instructions which when executed by one or more hardware processors cause:

identifying, by one or more hardware processors, a plurality of high frequency bands and a plurality of low frequency bands corresponding to a low frequency radio communication device, wherein the low frequency radio communication device comprises of a receiver;

generating, via a square wave generator and a device coil, one or more low frequency signals corresponding to the plurality of low frequency bands, wherein the square wave generator and the device coil correspond to the low frequency radio communication device, and wherein the one or more low frequency signals are generated by implementing a frequency oscillation technique on the plurality of low frequency bands, wherein the one or more low frequency signals generated, continuously interfere with communication between a transmitter module and the receiver and wherein the plurality of low frequency bands are generated by a standard spectrum analyzer;

integrating the one or more low frequency signals on a computing device by implementing a power controlling technique over the one or more integrated low frequency signals, wherein the computing device communicates with the low frequency radio communication device via the receiver and implementing a programmable IC to act as a relay controller for switching between one or more varied powers to amplify the integrated one or more low frequency signals, wherein power from the one or more integrated low frequency signals is enabled to be low enough to avoid electromagnetic interference to the computing device and the power from the one or more integrated low frequency signals is high enough to disturb the receiver;

facilitating non-disruption of the one or more integrated low frequency signals corresponding to at least one hearing aid device detected by the computing device by programmatically controlling the one or more integrated low frequency signals on the computing device, wherein the integrated one or more low frequency signals are programmatically controlled via a voltage controller for disrupting unauthorized communications in the low frequency radio communication device; and disrupting, via the integrated one or more low frequency signals on the computing device, unauthorized communications in the low frequency radio communication device and wherein the one or more generated low frequency signals for disrupting the unauthorized communications are amplified 1Hz frequency signals for creating an interruption in an external communication device working in audio frequency.

* * * * *